US005244433A

United States Patent [19]

Utterback

[11] Patent Number: 5,244,433

[45] Date of Patent: Sep. 14, 1993

[54] DETACHABLE VENTILATION SYSTEM FOR EMBALMING OR AUTOPSY TABLE

[76] Inventor: David F. Utterback, 4999 Barnsby La., Cincinnati, Ohio 45244

[21] Appl. No.: 722,863

[22] Filed: Jun. 28, 1991

[51] Int. Cl.[5] ..... B08B 15/00

[52] U.S. Cl. ..... 454/49; 5/600; 5/606

[58] Field of Search ..... 5/600, 606; 454/49, 454/56, 191

[56] References Cited

U.S. PATENT DOCUMENTS

| | | | |
|---|---|---|---|
| 1,896,951 | 2/1933 | Hahn | 454/49 |
| 2,374,488 | 4/1945 | Knox | 5/600 |
| 3,631,791 | 1/1972 | Harris et al. | 454/49 |
| 3,954,427 | 5/1976 | Jenn | 454/49 X |
| 4,346,058 | 8/1982 | Ridsby | 454/49 X |
| 4,562,827 | 1/1986 | Gerola | 454/49 X |
| 4,650,171 | 3/1987 | Howorth | 5/606 X |
| 4,678,489 | 7/1987 | Bertelson | 454/49 X |

FOREIGN PATENT DOCUMENTS

| | | | |
|---|---|---|---|
| 61230 | 6/1948 | Netherlands | 454/49 |
| 709920 | 1/1980 | U.S.S.R. | 454/49 |

*Primary Examiner*—Harold Joyce
*Attorney, Agent, or Firm*—Mark D. Miller

[57] ABSTRACT

A removable, adjustable ventilation system adapted for use with embalming or autopsy tables for removing vapors from the surface thereof which includes a longitudinal member having a suction slit along its entire length connected to an air removal mechanism. The member is designed to be placed immediately adjacent to the edge of the table so that vapors are removed from the table directly into said suction slit, through a double plenum, and to the outside. A fluid collection trough and access door are provided in the plenum for removal of fluids carried from the table by the suction of at the slit. Adjustable legs are also provided to allow the member to be moved up, down or tilted in accordance with the table.

10 Claims, 6 Drawing Sheets

DETACHABLE VENTILATION SYSTEM FOR EMBALMING OR AUTOPSY TABLE

BACKGROUND OF THE INVENTION

1, Field of the Invention

The present invention relates to a detachable ventilation apparatus for removing air containing unpleasant and potentially harmful vapors from the surface of an embalming or autopsy work table.

2, Description of Prior Art

Embalming and autopsy tables are widely used throughout this country in funeral homes, hospital pathology laboratories, medical examiners' laboratories, and the like. One of the most common chemicals used in both the embalming and autopsy process is formaldehyde, which is known to give off noxious vapors. In the early 1970s, with the advent of the Occupational Safety Health Administration (OSHA), acceptable levels of exposure to formaldehyde were established at 3 parts per million averaged over the typical eight-hour work day.

During the next two decades, considerable analysis of the adverse health effects of formaldehyde on laboratory animals was conducted, resulting in the classification of this chemical as a known animal carcinogen and a "possible" human carcinogen. Based in part upon this research, in 1988 OSHA reduced the permissible exposure limit to formaldehyde to one part per million averaged over the typical eight-hour workday. Furthermore, exposures in excess of 0.5 ppm would require employers to provide increased monitoring for formaldehyde in the work place and regular medical examinations for the exposed employees. Stricter exposure tolerances are likely to be implemented in the future.

It has been estimated by NIOSH that 1.6 MM workers are exposed to formaldehyde in their occupational settings. Because of the widespread use of formaldehyde in embalming and autopsy work and the potential for exposures in excess of the PEL, there is a particular need for a reliable ventilation system that may be used with any embalming or autopsy table.

Since almost all embalming fluids contain some level of formaldehyde, a particularly high level of these vapors is likely to be found in the immediate vicinity of the cadaver. In the early part of this century, tables and embalming boards such as those described in U.S. Pat. Nos. 776,313 and 1,614,651 failed to control any of the fumes or vapors from embalming or autopsy tables. Other patents such as U.S. Pat. No. 1,793,489 were designed to contain the vapors from a preserved body on a dissecting table with a closed, air-tight storage compartment. Unfortunately, once opened, such inventions provided no control or containment of these vapors.

Other patents such as U.S. Pat. Nos. 1,130,890 and 4,666,478 describe closed ventilation systems for recirculating the same air to either dry out the cadaver, or purify the foul air above the embalming or autopsy table. The latter patent suffers from several drawbacks including the need to permanently mount the hood above the table, and the requirement that the plexiglass sides or curtain be placed so as to closely surround the table, thus interfering with the most basic and ordinary access to the table by the undertaker, coroner or pathologist. Moving the plexiglass sides or curtains out of the way inhibits the vapor containment function of this patent, and the filtration system must be constantly changed in order to assure that it is functioning properly.

A separate group of patents relating to grill ventilation systems include U.S. Pat. Nos. 4,501,260 and 4,291,668; however, none of these patents are directed toward embalming or autopsy tables.

Two recent U.S. Pat. Nos., 4,901,410 and No. 4,980,956, resulted from the same original application, and each includes a pair of air exhaust vents in the form of longitudinal slits mounted on a tray support so as to extend along the sides of a tray upon which a cadaver rests. While these patents describe a means for eliminating vapors from the vicinity of the embalming table, they suffer from several drawbacks. First, each requires a specially designed tray for holding the cadaver. Second, the single exhaust plenum is designed to be located beneath the specially designed tray. Thus, these patents provide no flexibility for retrofitting the expensive existing equipment already in place in hundreds of funeral homes, hospital pathology laboratories, and medical examiner's laboratories across the country. Third, the inventions described in these patents require the tray and exhaust means to be mounted in the vicinity of a sink at a counter, resulting in an added restriction to adaptability for existing equipment.

It is therefore a principal object of the present invention to provide an adequate exhaust ventilation system for control of vapors and gases emanating from any embalming or autopsy table.

It is a further object of the present invention to provide one or more detachable slotted ventilation members in the form of inverted hoods which may be placed around all or part of the periphery of an autopsy or embalming table for removal of fumes, including, particularly, formaldehyde, emanating from the surface thereof.

It is a further object of the present invention to provide such slotted ventilation members in an inverted hood design which may be easily placed in proximity to, attached to, or detached from existing autopsy or embalming tables.

It is a further object of the present invention to provide such slotted ventilation members in an inverted hood design that may be placed around the periphery or along the longitudinal edges of an embalming or autopsy table such that the vent openings are just above the upper lip of the embalming table so as to maximize direct removal of odors and fumes, including formaldehyde, emanating from the surface of the table.

It is a further object of the present invention to provide such slotted ventilation members in an inverted hood design that may be placed along the longitudinal edges of an embalming or autopsy table such that the vent openings are just above the upper lip of the embalming table so as to minimize any interference with the handling of the body on the table by the mortician or coroner, because of the smallness of the vents located above the table surface.

It is a further object of the present invention to provide such slotted ventilation members in an inverted hood design that may be placed along the periphery or longitudinal edges of an embalming or autopsy table such that the vent openings are just above the upper lip of the embalming table such that the inverted hood is located predominately below and under the table so as to minimize any interference with the most basic and ordinary access by (knees or legs of the) mortician, pathologist or coroner utilizing a table equipped with the invention.

It is a further object of the present invention to provide such slotted ventilation members in an inverted hood design having an air removal exhaust outlet for conducting the fumes and odors to the outside.

It is another object of the invention to provide ventilation structures that are designed to universally fit to virtually all existing stationary and portable porcelain and stainless steel tables presently in use in the embalming and autopsy trade.

It is another object of the invention to provide a well and access door to allow retention of accumulated body fluids and embalming fluids and removal of the same from the ventilation members.

It is another object of the invention to provide slotted ventilation structures described herein manufactured with no sharp exposed edges that could result in personal injury, in particular, cuts to the skin and underlying tissue that may allow the embalmer's, coroner's or pathologist's blood supply to come in contact with blood or other tissues of the body being embalmed or autopsied.

It is another object of the invention to provide a support structure for the slotted ventilation members which allows the members to be independently and manually adjusted for overall height and angle as the height and angle of tilt of the table are adjusted.

It is another object of the invention to provide a support structure for the slotted ventilation members which allows the members to be easily removed for disinfection of all bodily fluids and tissues accumulated in the members.

It is another object of the invention to provide a means for the ventilation members used with stationary embalming and autopsy tables that allows the members to be retraced below the level of the table on either side so that bodies may be readily moved between the table and gurneys used to transport the bodies elsewhere.

It is another object of the invention to provide a support system for the ventilation members that allows the flip-top members to be retracted below the level of the table on either side so that bodies may be readily moved between the table and gurneys used to transport the bodies elsewhere.

SUMMARY OF THE INVENTION

The foregoing objects are achieved by this invention which provides a detachable longitudinal ventilation system for use in embalming or autopsy tables. The invention is designed to be placed along one (or both) side(s) of an existing embalming or autopsy table. In accordance with the invention, a longitudinal member is provided which has a slit opening along its length for receiving vapors, and adjustable legs for support. Accordingly, the invention may be raised, lowered, or tilted in conformity with the position of the embalming or autopsy table.

The longitudinal member is shaped much like a bench, the seat of which is designed to fit under the outside edge of the embalming table. The back of the bench-shaped longitudinal member extends upwardly along and above the edge of the embalming table. A slit opening extends along the entire length of the upper inside surface of the bench-shaped member, just above the edge (lip) of the embalming table.

The back of the bench-shaped member is a hollow plenum, and is attached along its bottom edge to a second hollow plenum having a modified triangular shape. The second plenum is, in turn, attached to an air removal means at one end. The triangularly shaped plenum points in a downward direction, so that any fluids removed from the table will collect in the point of this triangle. The air removal means is located above the fluid collection area to avoid removing the fluids from the plenum. A door is provided in the side of the plenum to allow access to the fluid collection area for removal of the fluids therefrom.

In use, the invention is placed along one (or both) side(s) of an embalming table, and adjusted (and, if necessary, tilted) to fit snugly against the table with the slit opening just above the edge of the table. The small triangular design helps prevent the invention from interfering with the hands, knees or feet of the user of the table and to provide drainage of fluids toward the trough at the apex of the triangle. While the table is in use, the air exhaust means is activated, lowering the pressure within the plenum. This lower pressure is transferred into the bench-shaped structure and results in the sucking of air and vapors from the table through the longitudinal slit opening. When use of the table is completed, the invention may be removed for cleaning. If the invention is left alongside the table after use, cleaning may be accomplished by opening the door on the side of the plenum and removing accumulated fluids.

DESCRIPTION OF THE PREFERRED EMBODIMENT

Figure 3:
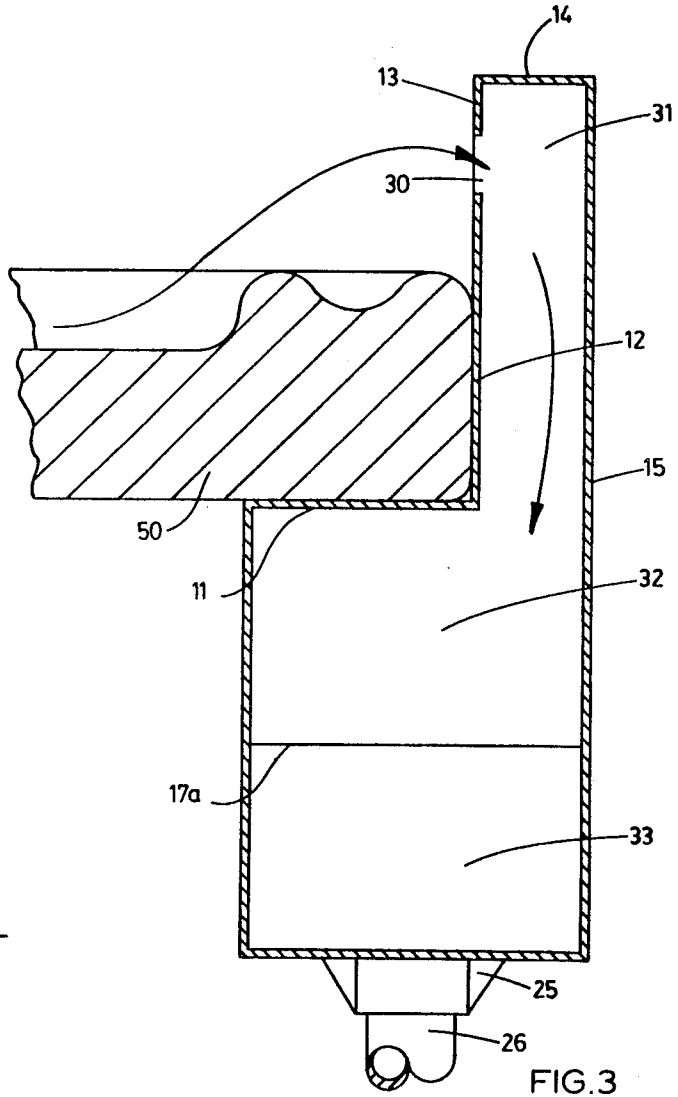
FIG. 3 is a detailed end cut-away view of the upper portion of the invention along lines 3—3 of FIG. 1.
Figure 4:
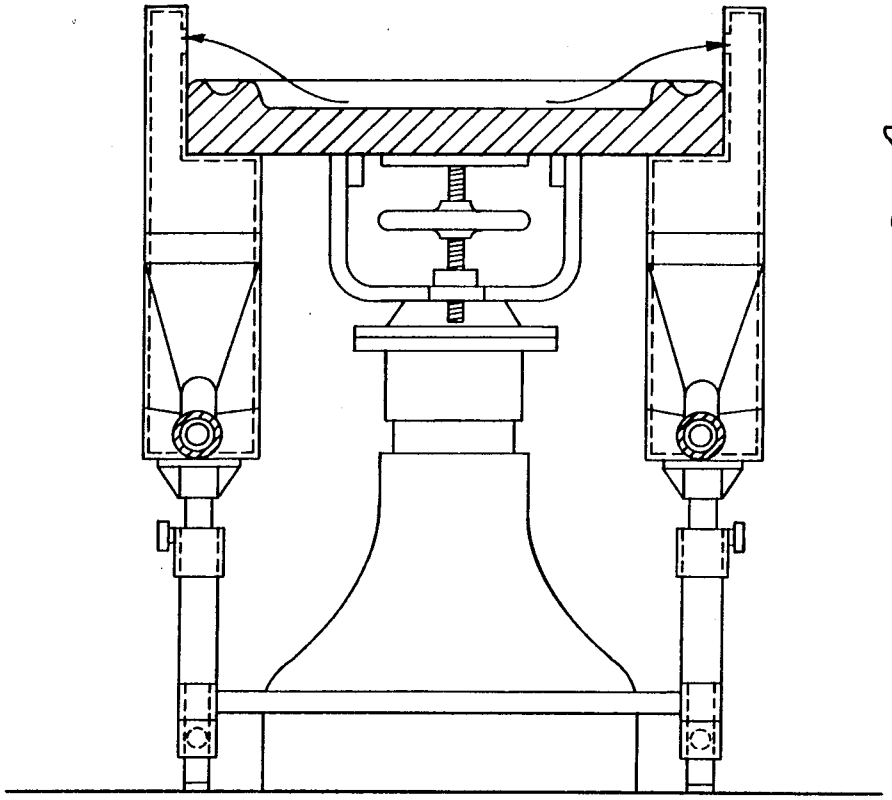
FIG. 4 is an end cut-away view of two of the inventions in place on either side of a typical embalming table along lines 4—4 of FIG. 1
Figure 5:
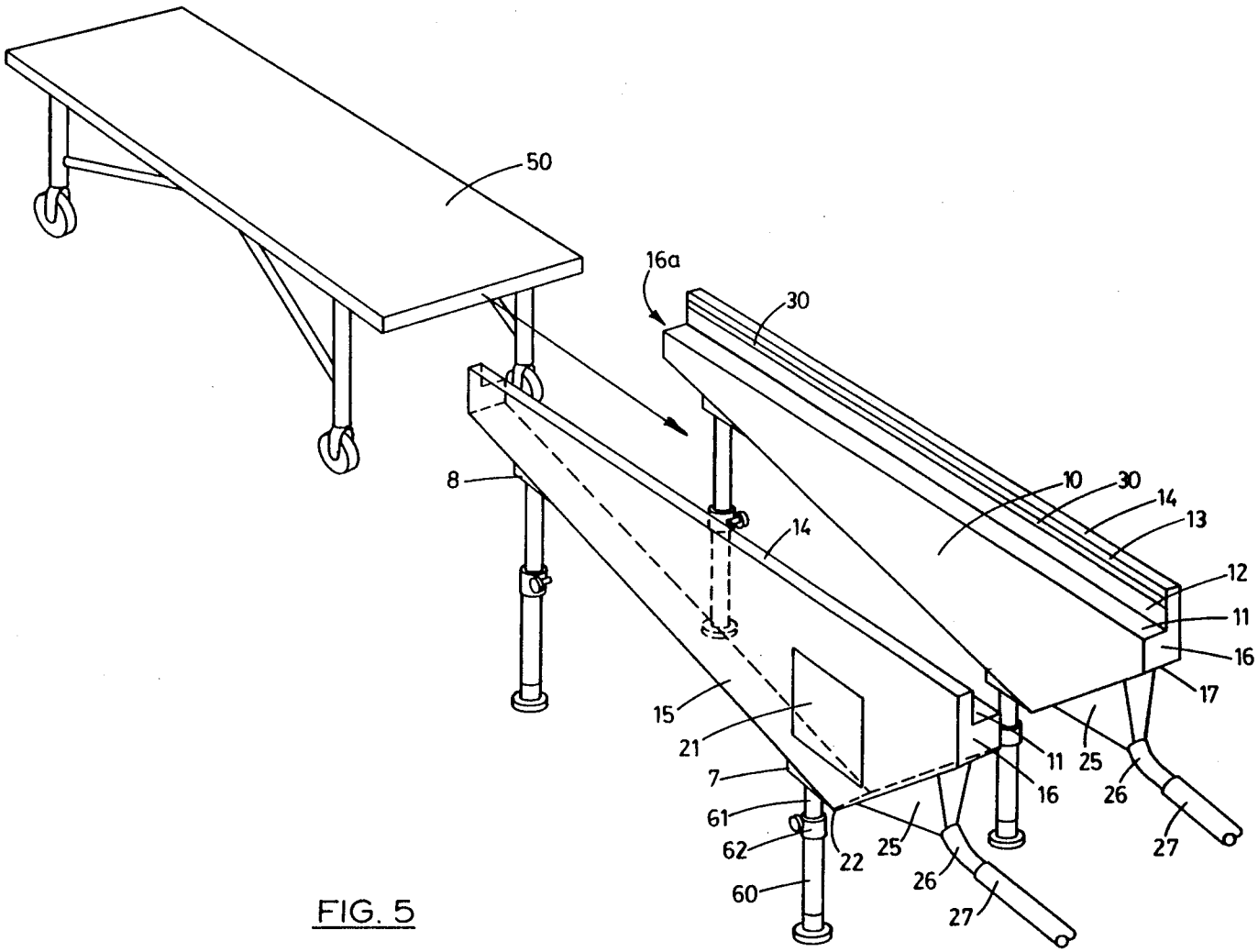
FIG. 5 is a perspective view showing two of the inventions in place on their respective supporting structures ready for placement along either side of a portable table.
Figure 6B:
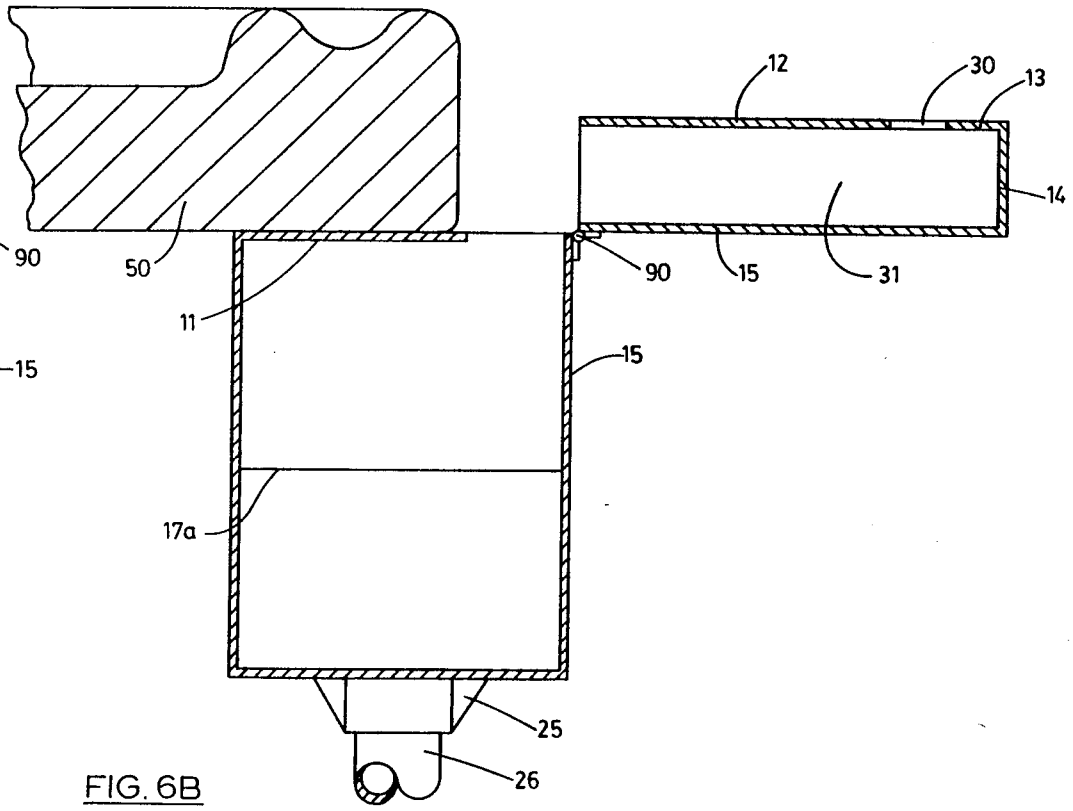
FIG. 6B shows the hinge of FIG. 6A in an open position.
Figure 6A:
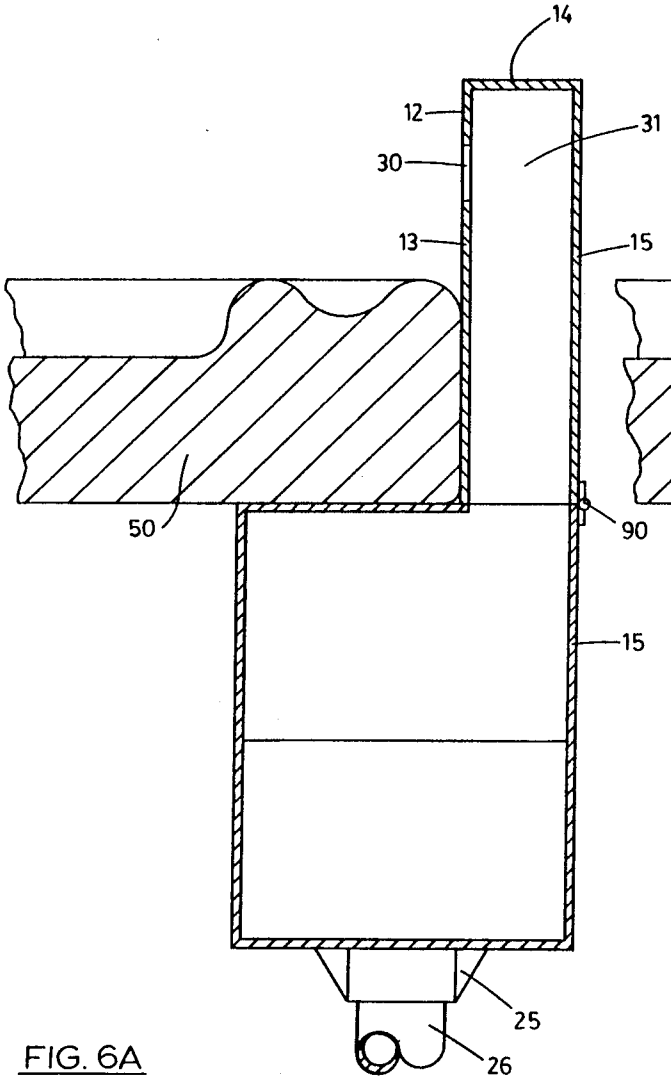
FIG. 6A is a detailed end cut-away view of the upper portion of the invention along lines 3—3 of FIG. 1, showing an alternative embodiment having a closed hinge.
Figure 7:
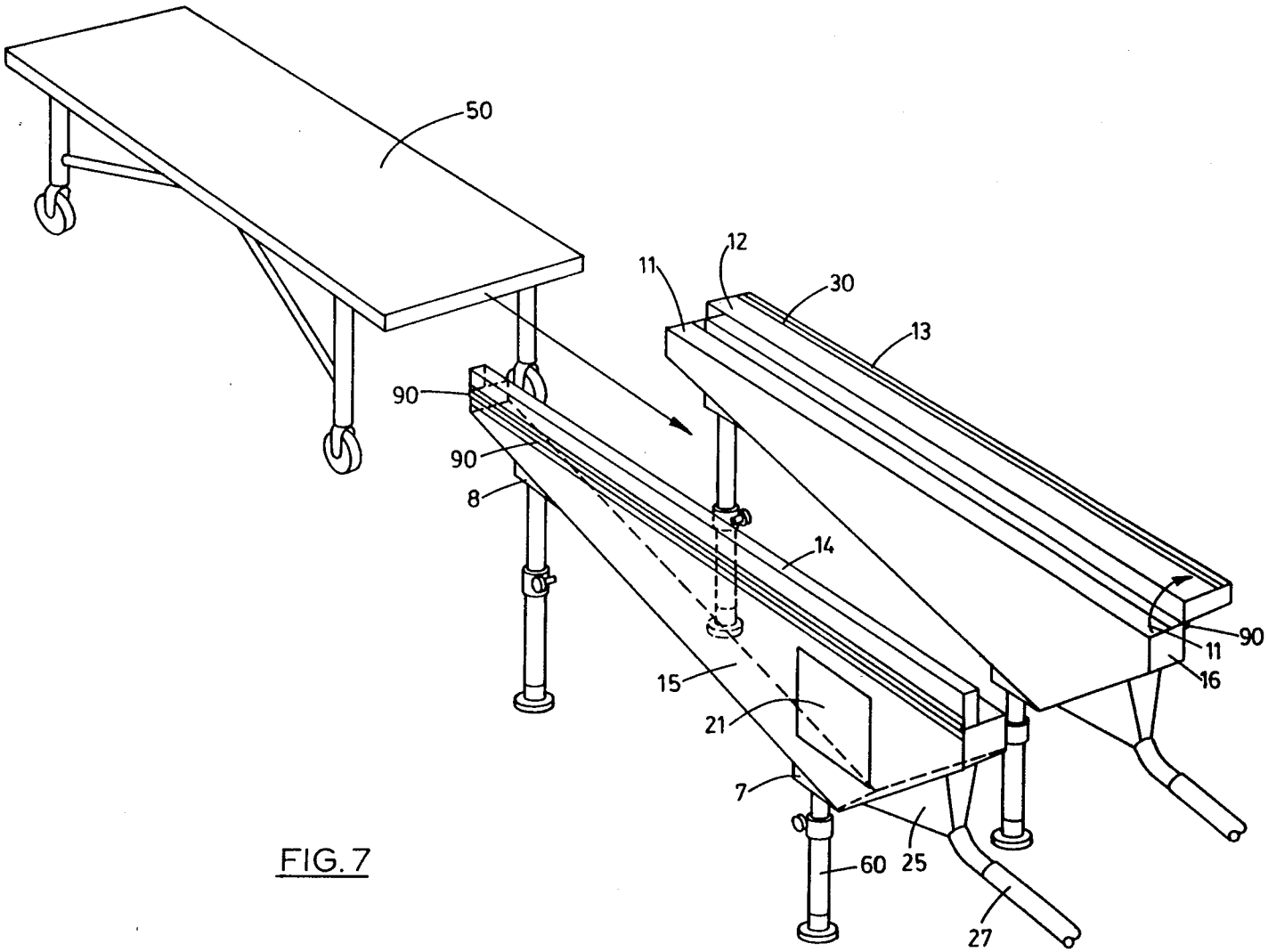
FIG. 7 is a perspective view of two of the hinged embodiments of the invention, one having the hinge in an open position.

Turning now to the drawings, wherein like reference characters designate the same element throughout the several views, and referring in particular to FIGS. 3 and 5, it can be seen that the ventilation member defines a bench-shaped structure along surfaces 11 and 12 which cradle the lower edge of the embalming table 50.

Longitudinal opening slit 30 is defined by walls 12 and 13 along the upper edge of the bench-shaped structure. Wall 13 is adjacent to and perpendicular to top wall 14 which, in turn, is adjacent to and perpendicular to back wall 15 defining an internal rectangular region 31 (see FIG. 3). Side walls 16 and **16*a* are shaped in the form of a "L" having their respective bottoms at joints 17 and 17***a*.

Figure 1:
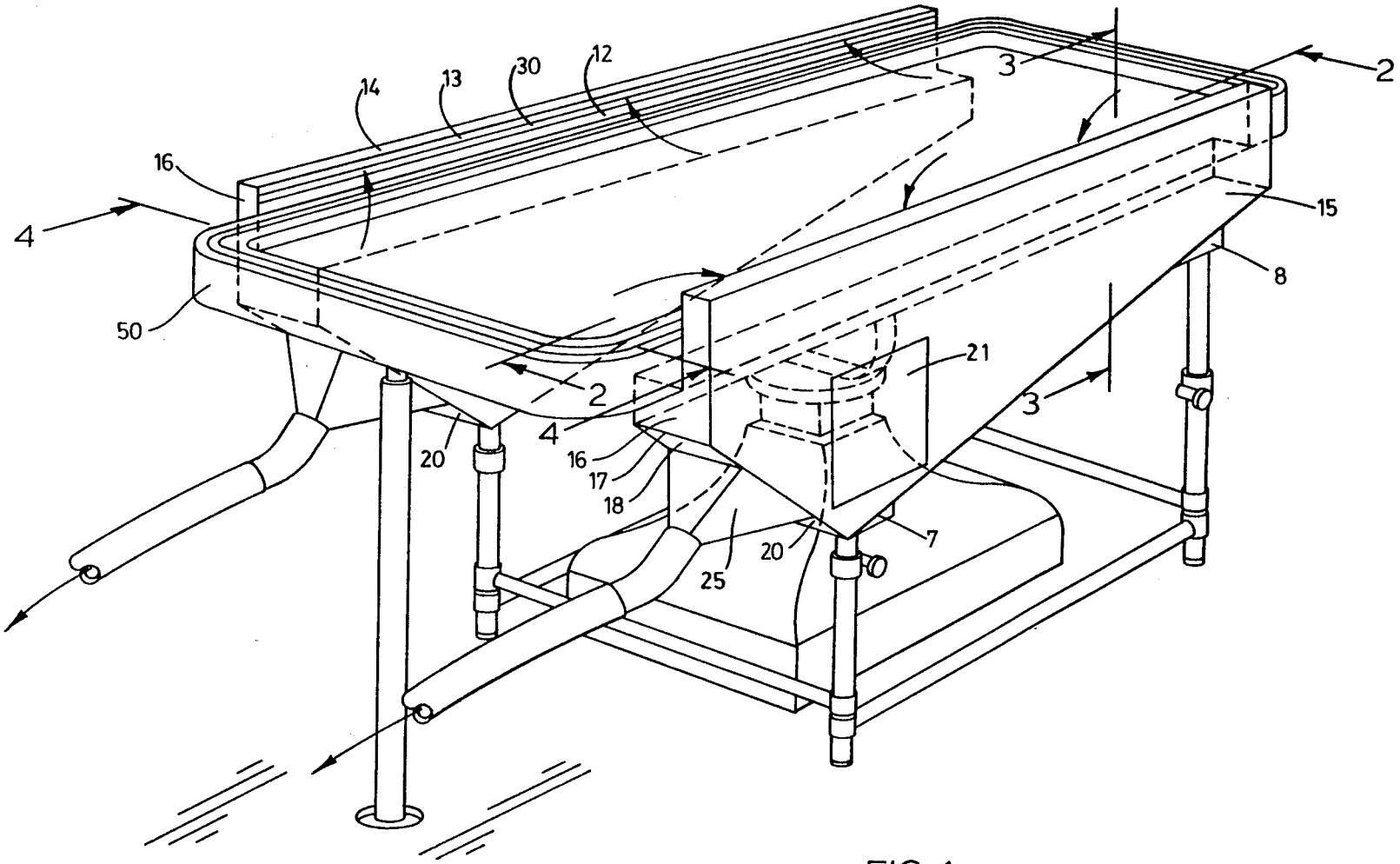
FIG. 1 is a perspective environmental view showing two longitudinal ventilation members in place on either side of a typical embalming table.
Figure 2:
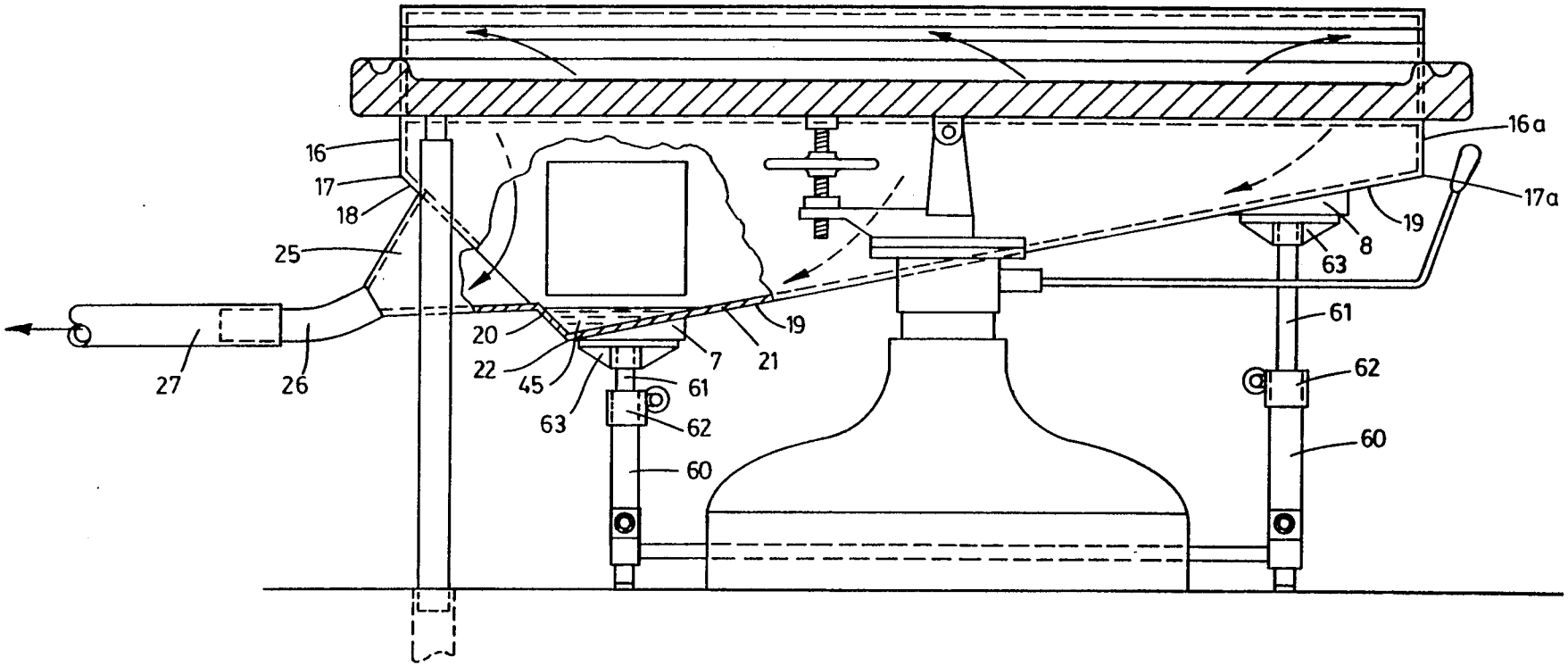
FIG. 2 is a side cut-away view of the invention along lines 2—2 of FIG. 1.

Referring to FIGS. 1 and 2, it can be seen that a lower angular structure (plenum) is defined by walls 18, 19 and 20 which meet at lower point 22. An exhaust opening 25 is attached to lower angular wall 18. Wall 20 extends in the same angle as wall 18 below the exhaust opening 25 defining a trough 45 for collection of embalming and bodily fluids which may accidently enter the plenum through the slot. Door 21 is provided in wall 15 to allow access to the trough 45 for removal of these fluids.

Referring to FIG. 3, it can be seen that the area of the rectangular region 31 defined by walls 12, 13, 14 and 15 is less than half the area of pentagonal region 32 defined generally by walls 10, 11, 15, 16, 16*a*, 18, 19 and 20. The area of region 33 is roughly twice that of region 32. Region 33 is defined generally by walls 10, 15, 18, 19 and 20, below lines 17 and 17A.

The proportional relationship of region 31 defines a primary plenum and the proportional relationship of region 32 define a secondary plenum.

The angular configuration of the secondary plenum region 32 allows the exhaust means 25 to be attached to angular walls 18 and 20 where it is out of the way of the legs and feet of the user and within the overall length of the embalming table, but still provides even airflow removal throughout the primary and secondary plenum, and especially along the longitudinal vent 30.

A pair of adjustable support structures defined generally by bearing 60 and shafts 61 are provided underneath the lower wall 19 of the invention. A first foot structure 7 is located near the lower most point of wall 19, just below the trough 45. A second foot structure 8 is located near the uppermost part of wall 19. A separate platform structure 63 is attached beneath each foot of structures 7 and 8. Each such platform 63 is, in turn, attached to the top of its respective shaft 61. The height of platforms 63 may be adjusted by sliding shafts 61 into or out of bearings 60, and locking them is place using lock mechanisms 62.

In use, a fan or other air evacuation means is remotely attached to hose 27 which fits over connecting pipe 26 which in turn is attached to evacuation chamber 25. The angles of walls 18, 19 and 20 define a secondary plenum, such that the internal static pressure that results in air motion removed through evacuation means 25 is the same throughout region 32. Because of the primary and secondary plenum design, the velocity of air passing through region 31 is at a minimum two times the velocity as that passing through region 32. As a result, the velocity of air coming into region 31 through longitudinal vent 30 is extremely great, even at relatively low evacuation fan speed and relatively small static pressure at the fan. By adjusting the fan speed upward, sufficient ventilation of the surface of the table 50 can be achieved. While a single ventilation structure may be sufficient to evacuate most fumes from the surface of the table, using a pair of such structures will assure the user of even air evacuation from the surface of the table.

Air enters the system along peripheral or longitudinal vent 30, and goes first into region 31, then into region 32, and finally into region 32 before it is pulled into exhaust opening 25 and down tube 26 and hose 27. The exhaust from the system is eventually discharged outside of the building in which the table is located.

Usually the embalming table is tilted at an angle different from horizontal. The adjustable support structures of shaft 61 and lock 62 allow the ventilation system to be tilted in conformity with the table tilt.

Other embodiments of the invention include a centrally located exhaust opening 25 having a tube 26 attached thereto which leads directly into the floor below the table. Another alternative embodiment replaces the secondary plenum of walls 18, 19 and 20 with a pair of combined plenum and exhaust openings attached directly below a longitudinal wall defined along lines 17 and 17A. Each of these alternative embodiments is less flexible and more cumbersome to use than the preferred embodiment, but may be more appropriate in certain applications.

An alternative embodiment provides a hinge 90 along wall 15 at the point where region 31 connects to region 32 which will allow the primary plenum and slot to be manually folded down and out of the way for the transfer of the cadaver between gurney and table.

It is to be understood that variations and modifications of the present invention may be made without departing from the scope thereof. It is also to be understood that the present invention is not to be limited by the specific embodiments disclosed herein, but only in accordance with appended claims read in light of the foregoing specification.

I claim:

1. A detachable ventilation system for an embalming or autopsy table comprising:

a. a hollow longitudinal member adapted for placement alongside said table, said member having a hollow bench-shaped upper region with a rectangularly shaped top portion and a separate attached rectangularly shaped seat portion, and a hollow triangularly-shaped lower region, wherein a narrow longitudinal slit opening is provided along the upper inside surface of the top portion, and an air evacuation outlet is provided leading away from the lower region, b. a plurality of adjustable legs attached below said hollow longitudinal member, and c. a means for removing air from said longitudinal member, whereby said seat portion fits underneath and against said table, and said top portion extends upwardly along and above the edge of said table so that said longitudinal slit opening is immediately above the edge of said table.

2. The invention described in claim 1 wherein said triangular lower region of said longitudinal member points downward to form a trough into which fluids may collect.

3. The invention described in claim 2 wherein a door is provided in the side of said triangular lower region to allow access to said trough for removal of any fluids that have collected there.

4. The invention described in claim 1 wherein the inside hollow area defined by the rectangular top portion of said bench-shaped region of said longitudinal member is less than half of the area defined by the rectangular seat portion of said bench-shaped region.

5. The invention described in claim 1 wherein a hinge is provided on said bench-shaped upper region to allow the top of said bench-shaped region to fold down for easy access.

6. The invention described in claim 4 wherein the relationship of the sizes of the rectangular top portion to the rectangular seat portion forms a double-plenum which equalizes the static pressure in the longitudinal member which, in turn, equalizes the linear velocity of air entering along the length of the slit opening.

7. A movable ventilation system for an embalming or autopsy table comprising:

a. a bench-shaped hollow longitudinal member having a top and a seat adapted for placement along one side of said table having a narrow slit opening along the upper edge of one of its sides, b. a hollow angular member having a long side and a short side connected immediately below said longitudinal member, c. an air exhaust opening connected to the short side of said angular member, d. a door on said angular member to allow access to the inside of said member, e. a plurality of adjustable support legs below said angular member, and f. means for removing air through said air exhaust opening.

8. The invention defined in claim 7 wherein said angular member points downward to form a trough into which fluids may collect.

9. The invention described in claim 7 wherein the inside hollow area of said bench-shaped member is defined by an upper rectangular part and an attached lower rectangular part, wherein the area defined by the upper part is less than half of the area defined by the lower part.

10. The invention described in claim 7 wherein a hinge is provided on said bench-shaped member to allow the top of said bench-shaped member to fold down for easy access.

* * * * *

UNITED STATES PATENT AND TRADEMARK OFFICE

CERTIFICATE OF CORRECTION

PATENT NO. : 5,244,433

DATED : September 14, 1993

INVENTOR(S) : Utterback & Feigley

It is certified that error appears in the above-indentified patent and that said Letters Patent is hereby corrected as shown below:

On the title page, item [76] Inventors:

Charles Eugene Feigley
2725 Duncan Street
Columbia, South Carolina 29205 is a co-inventor of the patented invention.

Signed and Sealed this

Twenty-fourth Day of May, 1994

Bruce Lehman

*Attest:*

BRUCE LEHMAN

*Attesting Officer*

*Commissioner of Patents and Trademarks*